US006691998B2

(12) United States Patent
Mori

(10) Patent No.: US 6,691,998 B2
(45) Date of Patent: Feb. 17, 2004

(54) IMAGE FORMING APPARATUS WITH SEPARABLE MEDIUM CASSETTES AND PLURAL RESIST ROLLERS

(75) Inventor: Hirotaka Mori, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 86 days.

(21) Appl. No.: 09/987,177

(22) Filed: Nov. 13, 2001

(65) Prior Publication Data

US 2002/0056962 A1 May 16, 2002

(30) Foreign Application Priority Data

Nov. 13, 2000 (JP) ..... 2000-345512

(51) Int. Cl.[7] ..... B65H 3/44

(52) U.S. Cl. ..... 271/9.05; 271/114; 271/152; 271/242; 271/9.11; 399/110

(58) Field of Search ..... 271/9.01, 9.02, 271/9.03, 9.04, 9.05, 9.06, 9.07, 9.08, 9.09, 9.1, 9.11, 9.12, 9.13, 114, 152, 242; 399/110

(56) References Cited

U.S. PATENT DOCUMENTS 5,199,694 A * 4/1993 Iseda ..... 271/9.05
5,383,654 A * 1/1995 Iseda ..... 271/9.05
5,732,321 A * 3/1998 Ishizuka et al. ..... 399/391
5,758,249 A * 5/1998 Dutton et al. ..... 399/391
5,963,755 A * 10/1999 Ueda et al. ..... 399/23
6,049,346 A * 4/2000 Cho ..... 347/153
6,148,172 A * 11/2000 Kanda et al. ..... 399/391
6,161,829 A * 12/2000 Kusumi ..... 271/9.05

FOREIGN PATENT DOCUMENTS

JP A 5-201562 8/1993
JP A 2000-118803 4/2000

* cited by examiner

*Primary Examiner*—Patrick Mackey
(74) *Attorney, Agent, or Firm*—Oliff & Berridge, PLC

(57) ABSTRACT

A laser-beam printer includes a main unit and a plurality of tray units that can be stacked one upon the other under the main unit. Each of the tray units has a resist roller. The resist roller has a function of adjusting a deviation of a recording sheet fed from stacked sheets on a sheet supporting plate by a sheet feed roller and a function of feeding the recording sheet fed from a tray unit provided immediately below the main unit toward the main unit. A resist roller for adjusting a deviation of the recording medium is also provided upstream from an image forming unit in the main unit.

19 Claims, 12 Drawing Sheets

IMAGE FORMING APPARATUS WITH SEPARABLE MEDIUM CASSETTES AND PLURAL RESIST ROLLERS

BACKGROUND OF THE INVENTION

1. Field of Invention

The invention relates to an image forming apparatus that includes a recording medium feeding device that feeds a recording medium, one by one, from stacked recording mediums, and to recording medium feeding apparatuses that can be stacked one upon the other under the image forming apparatus.

2. Description of Related Art

A conventionally-known image forming apparatus separates a recording medium, such as a recording sheet, one by one, from stacked recording mediums accommodated in a cassette using a separator, such as a sheet feed roller, and forms an image on the separated recording medium in a main body of the image forming apparatus. Each recording medium feeding apparatus is structured so that the recording medium feeding apparatuses can be stacked one upon the other. Therefore, for example, a plurality of the recording medium feeding apparatuses are provided according to the size of the recording mediums (such as for B5-size, A4-size, or B4-size sheets). By stacking the recording medium feeding apparatuses one upon the other, a desired size recording medium can be fed from the recording medium feeding apparatus accommodating the desired size recording mediums therein.

In this case, the plurality of the recording medium feeding apparatuses are stacked so that the desired size recording medium is fed, to form an image in the main body of the image forming apparatus, without changing the cassette. In the image forming apparatus, the desired number of the recording medium feeding apparatuses can be stacked one upon the other. Thus, the image forming apparatus does not become oversize.

However, when the plurality of the recording medium feeding apparatuses are stacked one upon the other, a feeding path of the recording medium becomes longer for each successively lower recording medium feeding apparatus. This easily causes a deviation of the recording medium, that is a skew of the recording medium. Generally, upstream of an image forming unit, for forming an image on the recording medium, a deviation adjusting means, such as a resist roller, is provided. The deviation adjusting means temporarily stops a leading edge of the recording medium to adjust the deviation of the recording medium. However, if the feeding path of the recording medium becomes long, the deviation adjusting means may not satisfactorily adjust the deviation of the recording medium.

SUMMARY OF THE INVENTION

The invention provides a recording medium feeding apparatus and an image forming apparatus that can effectively limit the deviation of a recording medium.

According to one aspect of the invention, an image forming apparatus includes a plurality of recording medium feeding apparatuses that can be stacked one upon the other, an image forming apparatus body, first deviation adjusting means that is provided upstream from an image forming unit that forms the image in the image forming apparatus body, and second deviation adjusting means that is provided downstream from the separator in each of the recording medium feeding apparatuses. Each of the recording medium feeding apparatuses accommodates a cassette that holds a stack of recording mediums, has a separator for separating the recording mediums, one by one, from the stack, and feeds the separated recording medium. The image forming apparatus body can be stacked on top of the recording medium feeding apparatuses and forms an image on the recording medium fed from one of the recording medium feeding apparatuses. The first and second deviation adjusting means temporarily stop the recording medium to adjust its deviation while contacting a leading edge of the recording medium. The second deviation adjusting means also functions as conveying means for conveying the recording medium fed from one of the lower recording medium feeding apparatuses toward the image forming apparatus body.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
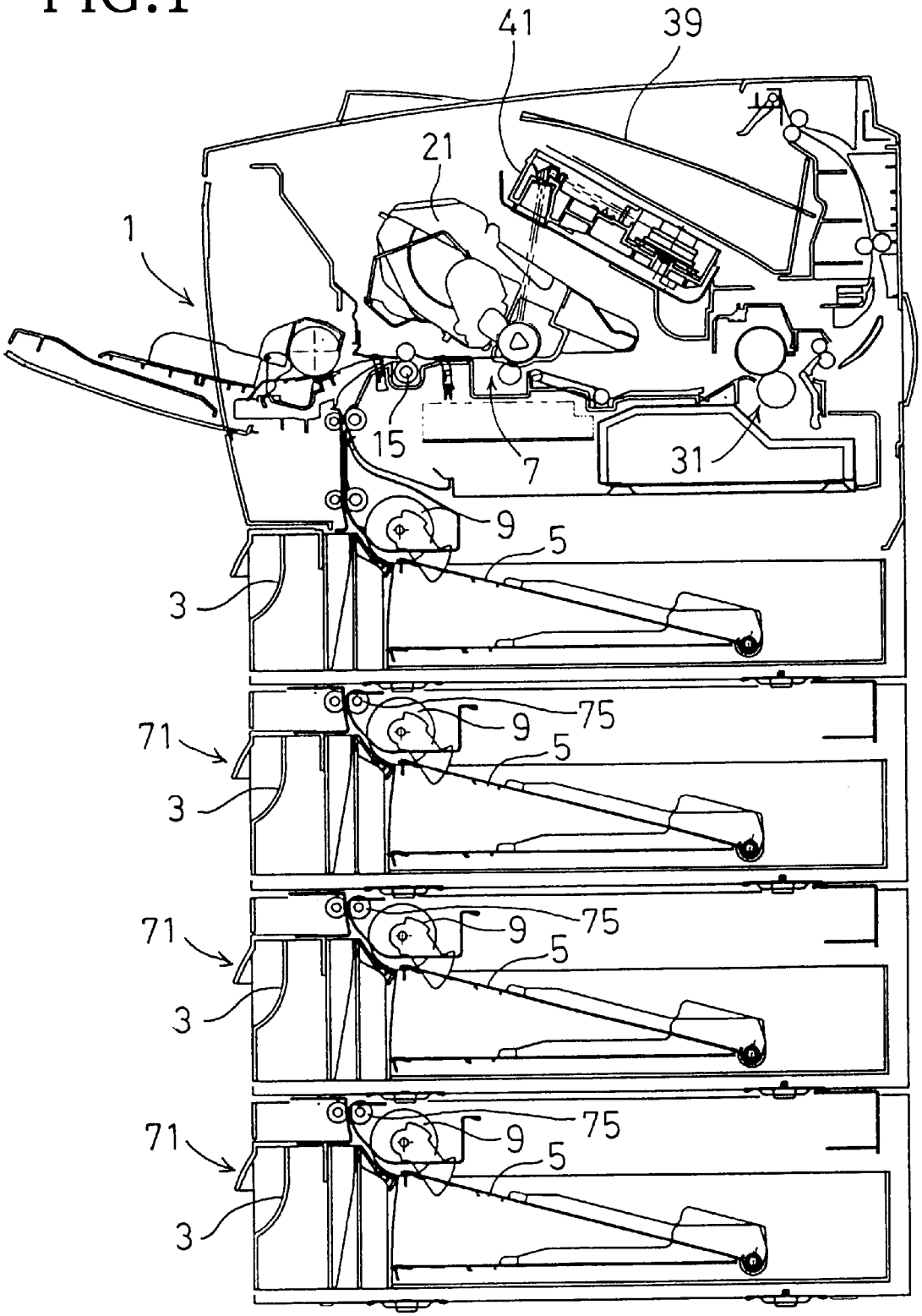
FIG. 1 is a longitudinal sectional view showing a laser-beam printer of the invention.

An embodiment of the invention will be described with reference to the accompanying drawings. As shown in FIG. 1, a laser-beam printer includes a main unit 1 and tray units 71 that can be stacked one upon the other under the main unit 1.

Figure 2:
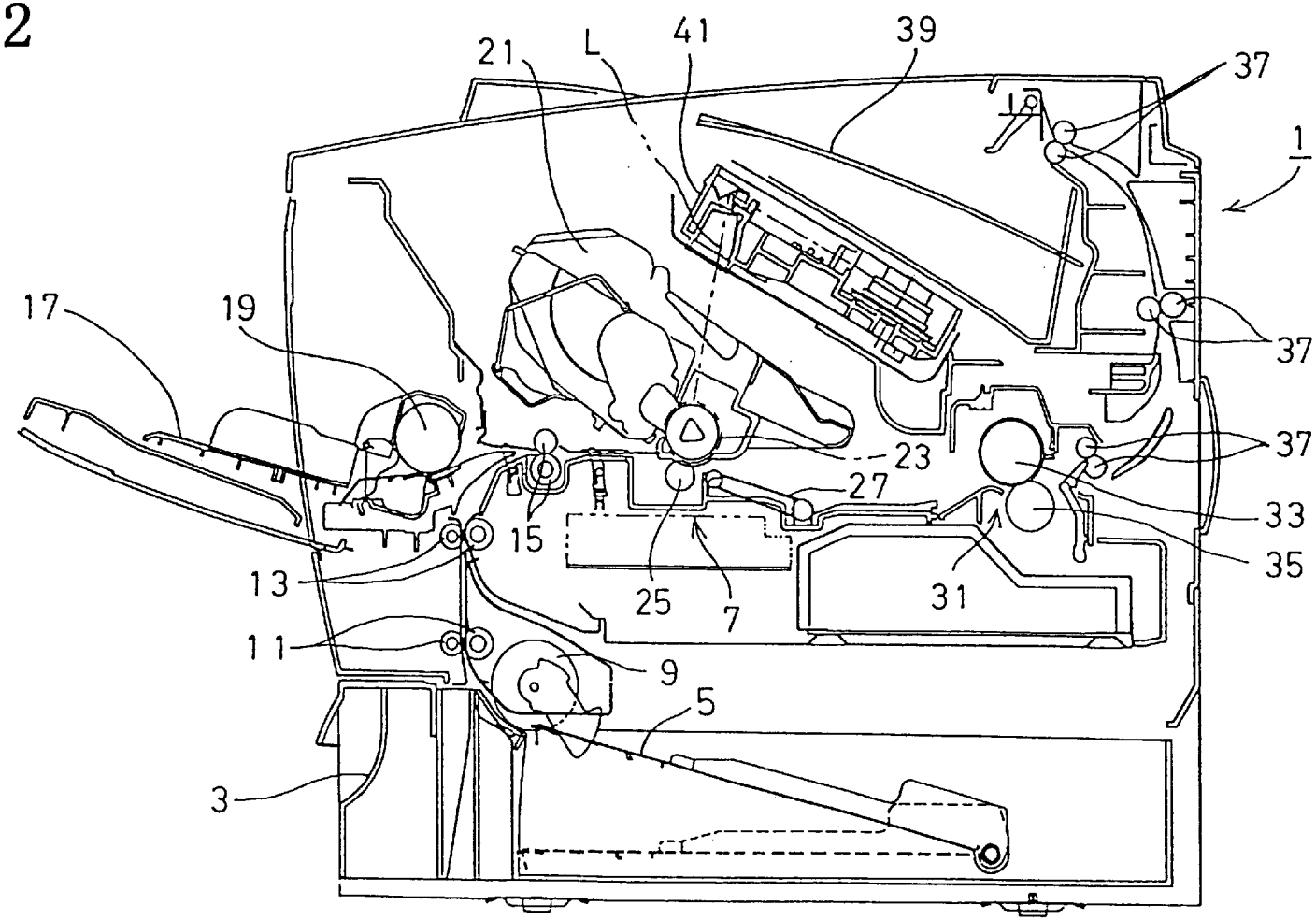
FIG. 2 is a longitudinal sectional view showing a main unit of the laser-beam printer.

As shown in FIG. 2, the main unit 1 includes a sheet cassette 3, which is detachably attached to a lower portion of the main unit 1. The sheet cassette 3 includes a sheet supporting plate 5, which is upwardly urged by a spring (not shown). A sheet feed roller 9 is disposed above a free end side of the sheet supporting plate 5. The sheet feed roller 9 feeds recording sheets, one by one, from the recording sheets (not shown) stacked on the sheet supporting plate 5, toward an image forming unit 7. Disposed between the sheet feed roller 9 and the image forming unit 7, are two pairs of conveying rollers 11, 13 for conveying the recording sheet and a resist roller 15 disposed in order from below. The resist roller 15 temporarily stops the sheet to adjust a deviation of the sheet. Recording sheets stacked on a manual sheet feed tray 17 can be also conveyed to the resist roller 15 by a sheet feed roller 19.

The image forming unit 7 includes a photoconductive drum 23, which is provided in a process cartridge 21, and a transfer roller 25, which is disposed to be opposed to the photoconductive drum 23. While the sheet is being passed between the photoconductive drum 23 and the transfer roller 25, an image is formed on the sheet by toner. Then, the sheet is conveyed to a fixing unit 31 via a conveying belt 27. In the fixing unit 31, the sheet having the toner image is sandwiched between a heat roller 33 and a pressing roller 35, so that the toner image on the sheet is fixed by heat. After that, the sheet having the fixed image is conveyed by three pairs of conveying rollers 37 to be discharged on an output tray 39 provided at the top of the main unit 1. Between the output tray 39 and the process cartridge 21, is a scanner unit 41, which exposes and scans the photoconductive drum 23 by laser light L.

Figure 3:
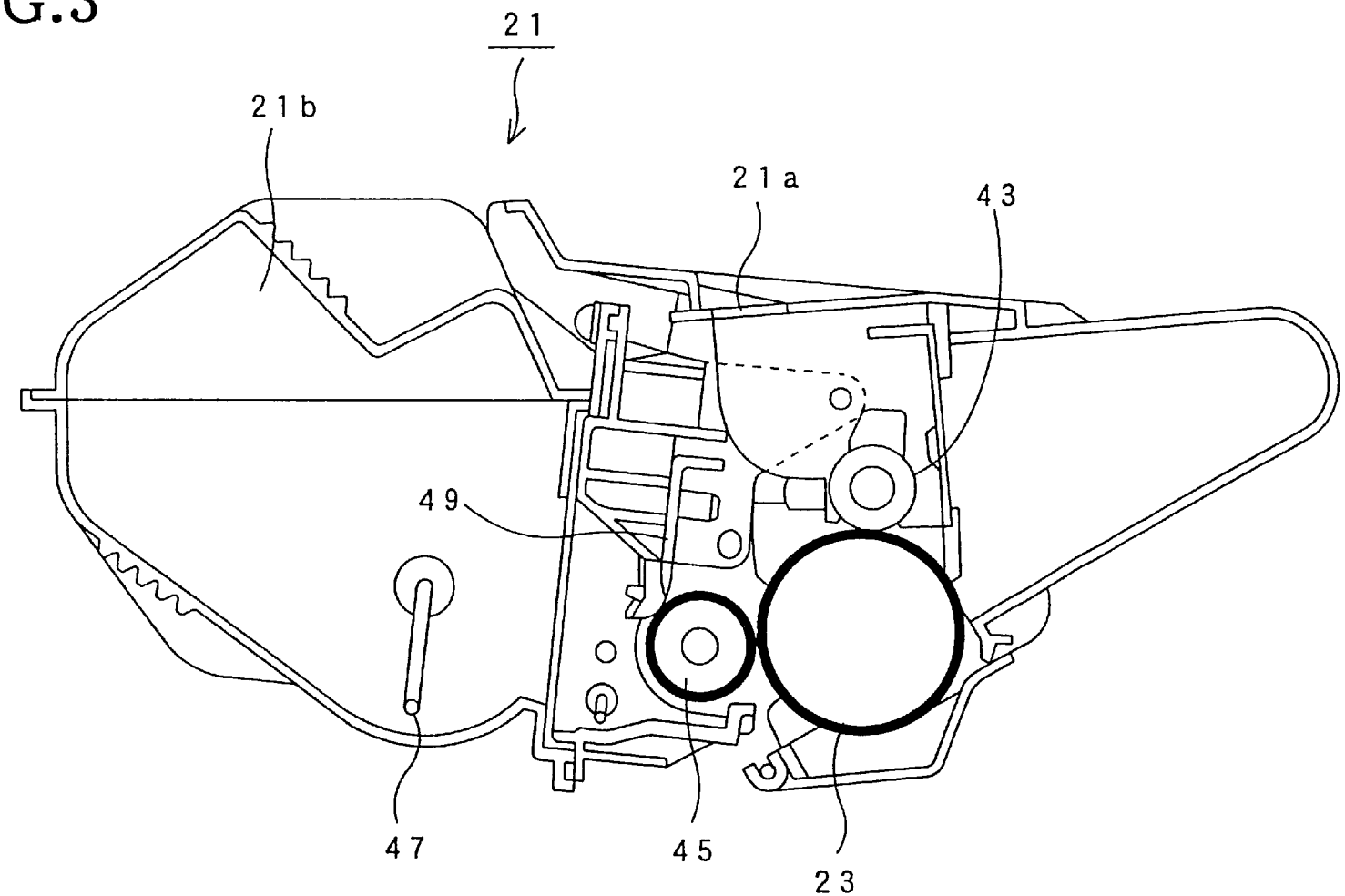
FIG. 3 is a longitudinal sectional view showing a process cartridge in the laser-beam printer.

As shown in FIG. 3, the process cartridge 21 includes the rotatable photoconductive drum 23, having a photoconductive layer around its surface, and a charging roller 43, which charges the surface of the photoconductive drum 23 at an uniform electric potential. An electrostatic latent image is formed on the surface of the photoconductive drum 23, charged by the charging roller 43, by the laser light L (see FIG. 2) emitted from the scanner unit 41 via an opening 21*a*. Then, a developing roller 45 supplies toner onto the surface of the photoconductive drum 23, and thus the electrostatic latent image is developed. The toner adhered to the surface of the photoconductive drum 23 as described above is transferred onto the recording sheet passing between the photoconductive drum 23 and the transfer roller 25.

The charging roller 43 and the developing roller 45 rotate, following the photoconductive drum 23. The process cartridge 21 includes an agitator 47, a layer-thickness regulating blade 49 and other well-known parts. The agitator 47 agitates toner contained in a toner container 21*b* and supplies the toner to the developing roller 45. The layer-thickness regulating blade 49 frictionally charges the toner adhered to the surface of the developing roller 45.

Figure 4:
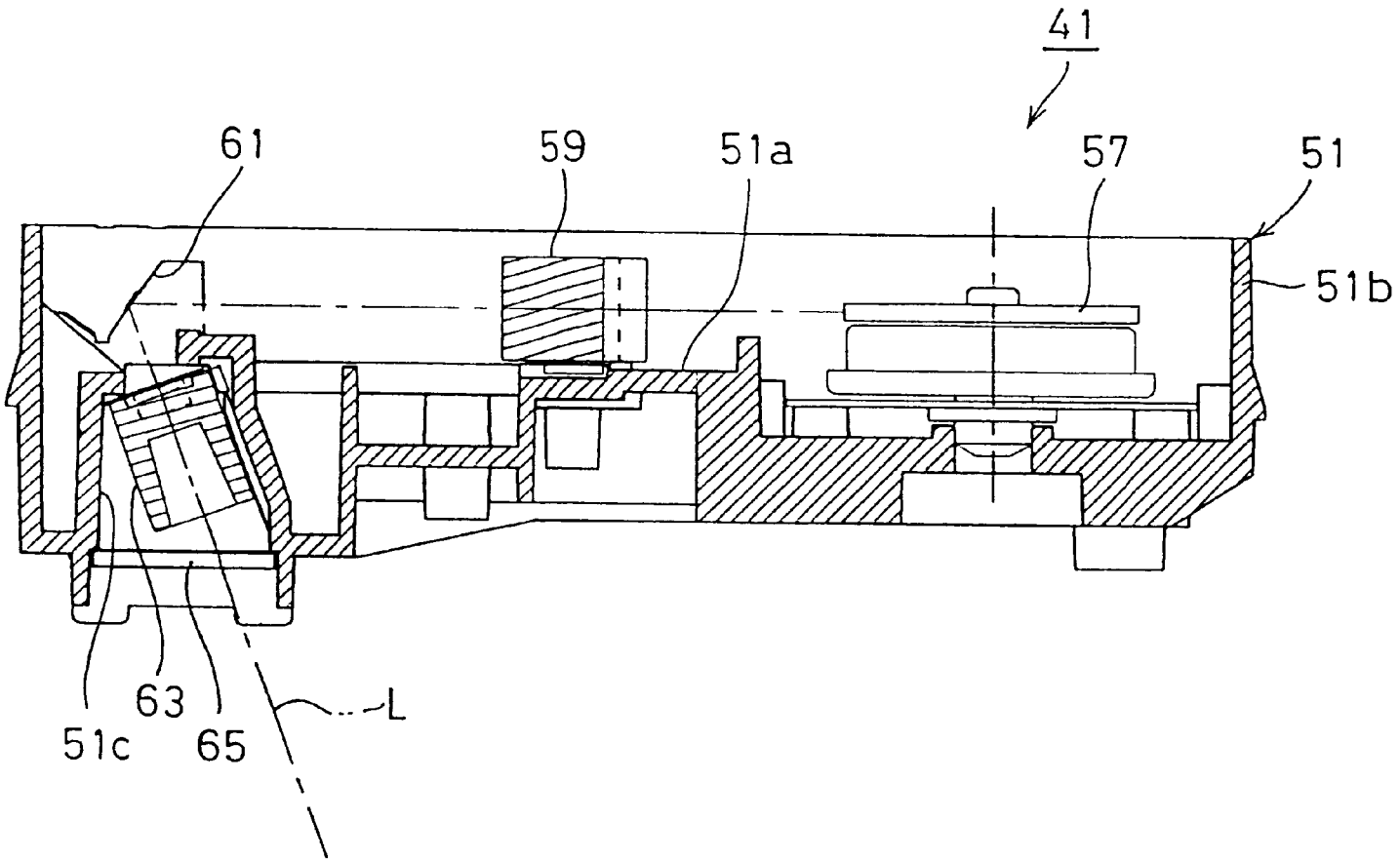
FIG. 4 is a longitudinal sectional view showing a scanner unit in the laser-beam printer.

As shown in FIG. 4, the scanner unit 41 has a housing 51 with its upper surface open. The housing 51 includes a substantially flat bottom plate 51*a* and a side wall 51*b* standing from a periphery of the bottom plate 51*a*. On the surface of the bottom plate 51*a*, a polygon mirror 57 is fixed to deflect laser light L emitted from a laser emitting unit (not shown) in a predetermined scanning direction.

After the laser light L, deflected by the polygon mirror 57 passes through an f-theta lens 59, the laser light L is reflected off a reflecting mirror 61 and then is emitted from a light emitting hole 51*c* formed in a bottom of the housing 51. By emitting the laser light L from the laser emitting unit at appropriate timing, a desired electrostatic latent image is formed on the surface of the photoconductive drum 23, and an image according to the electrostatic latent image can be formed on a recording sheet. As shown in FIG. 4, a cylindrical lens 63 and a cover glass 65 are provided in the light emitting hole 51*c*. The laser light L reflected by the reflecting mirror 61 passes through the cylindrical lens 63. The cover glass 65 covers the light emitting hole 51*c* from the bottom.

Figure 5:
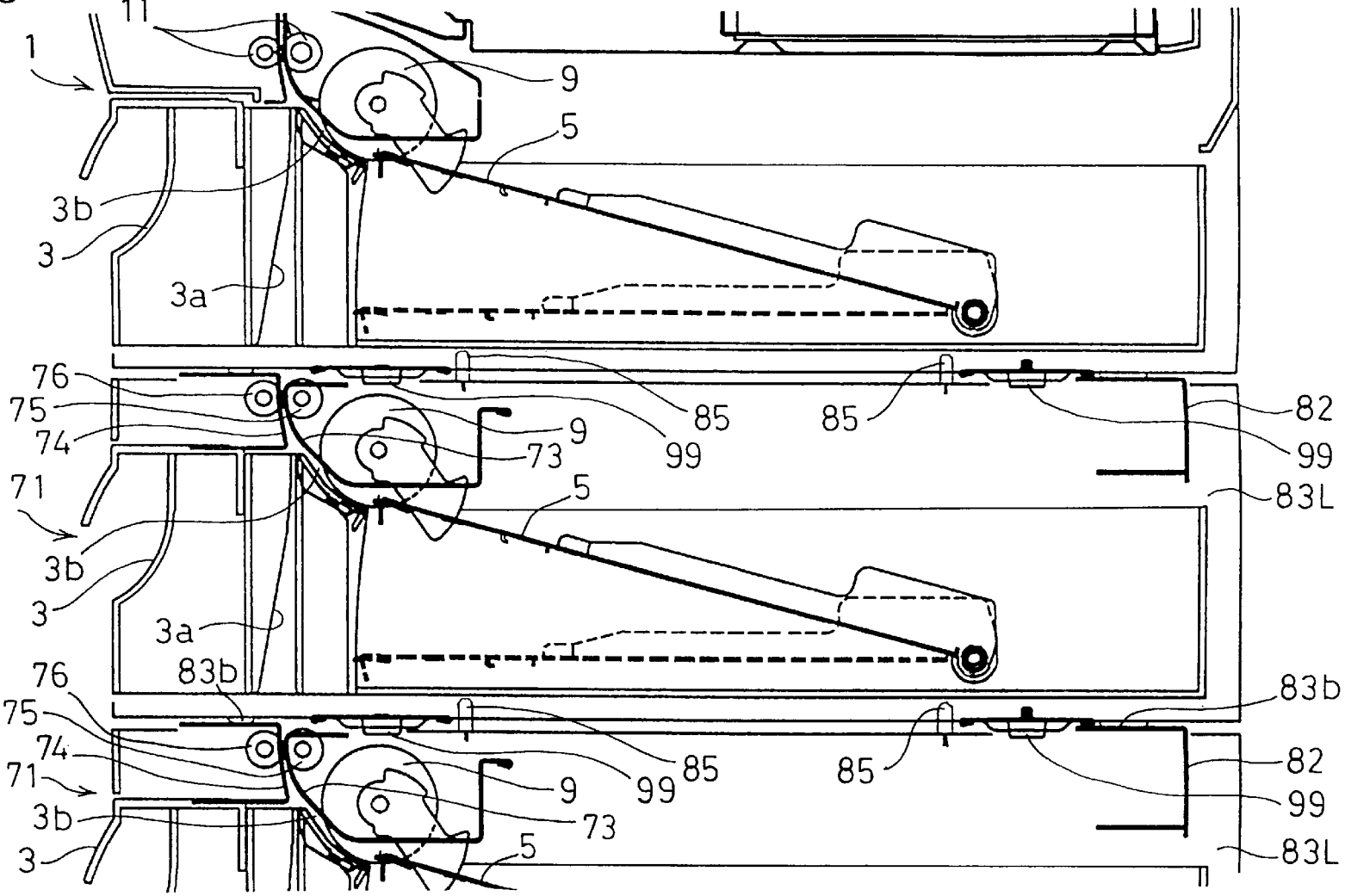
FIG. 5 is a longitudinal sectional view showing details of tray units of the laser-beam printer.

As shown in FIG. 5, each of the tray units 71 includes a sheet cassette 3, a supporting plate 5 and a sheet feed roller 9, which have the same structure as those provided in the main unit 1. In each of the sheet cassettes 3, a second sheet passage 3*a* is provided. A recording sheet is fed to the each higher tray unit 71 by passing through the second sheet passages 3*a*. In each of the tray units 71, the second sheet passage 3*a* joins a first sheet passage 3*b*, through which a recording sheet fed from the sheet feed roller 9 passes. These structures are the same as those of the sheet cassette 3 in the main unit 1.

Figure 6:
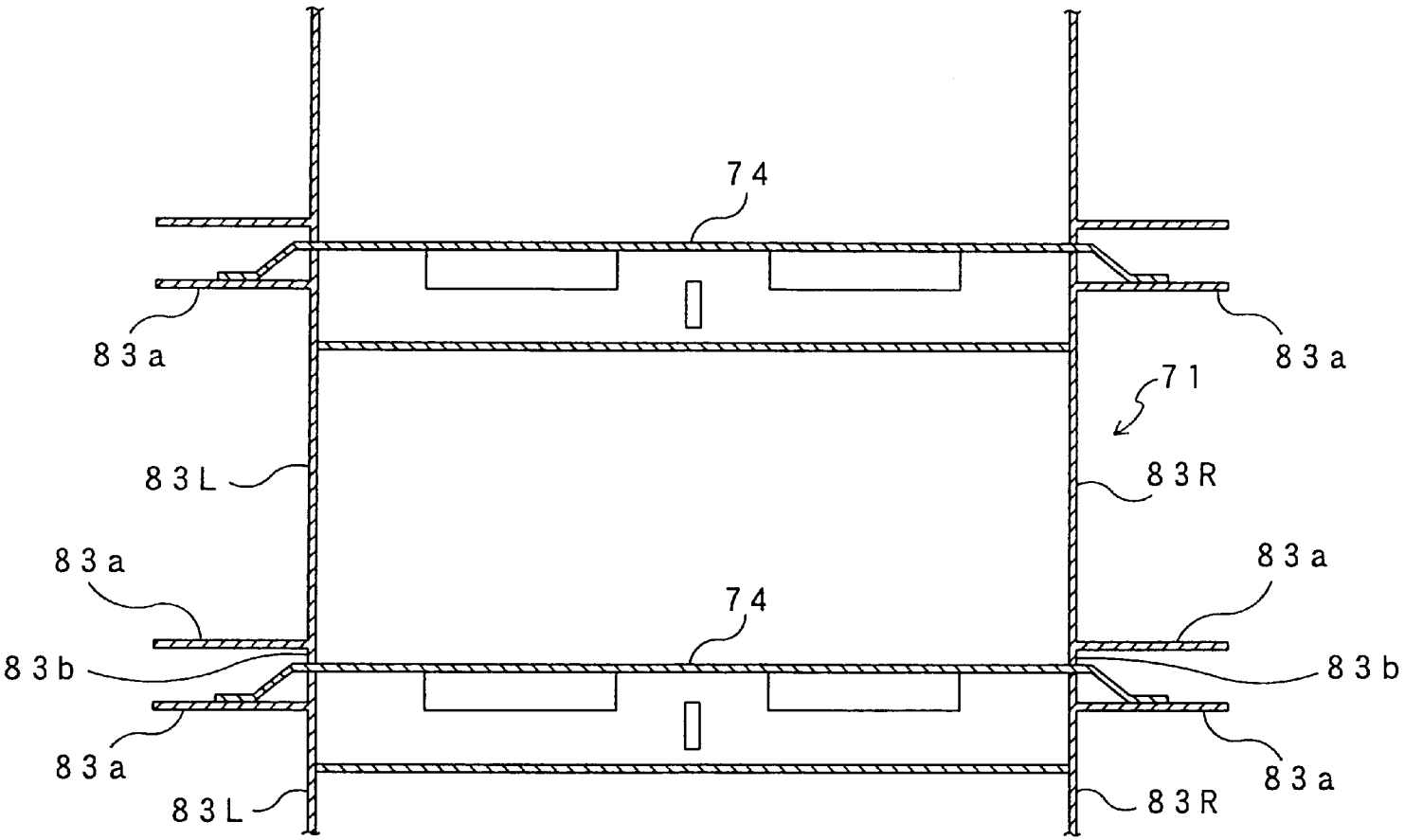
FIG. 6 is a transverse sectional view showing the tray units.

In each tray unit 71, the sheet feeding path at the confluence of the first and second sheet passages 3*b*, 3*a* is defined by chutes 73, 74. At the confluence, a resist roller 75 and a following roller 76 are provided. As shown in FIGS. 5 and 6, each tray unit 71 includes side frames 83L, 83R, which are supported by the chutes 73, 74 and a frame 82 (see FIG. 5) provided at a end opposed to the end where the chutes 73, 74 are provided.

Pin holes (not shown) are formed in eaves 83*a* of the side frames 83L, 83R. Pins 85 (see FIG. 5) are inserted into the respective pin holes, so that each tray unit 71 is positioned in a horizontal direction. Feet 83*b* are formed at a lower end of the side frames 83L, 83R. The feet 83*b* contact the chute 74 and the frame 82 of the lower tray unit 71, so that an interval between adjacent tray units 71 is defined. With this structure, as shown in FIG. 6, the upper ends of the side frames 83L, 83R contact the feet 83*b* of the side frames 83L, 83R of the upper tray unit 71, while a plate constituting the chute 74 or the frame 82 is sandwiched between them. Thus, the interval between adjacent tray units 71 is precisely secured even though a plurality of the tray units 71 are stacked one upon the other. Consequently, the resist roller 75 in each tray unit 71 can be located at regular intervals with high precision.

Next, driving mechanisms of the sheet feed roller 9 and the resist roller 75 in each tray unit 71 will be described with reference to FIGS. 7 to 10.

Figure 7:
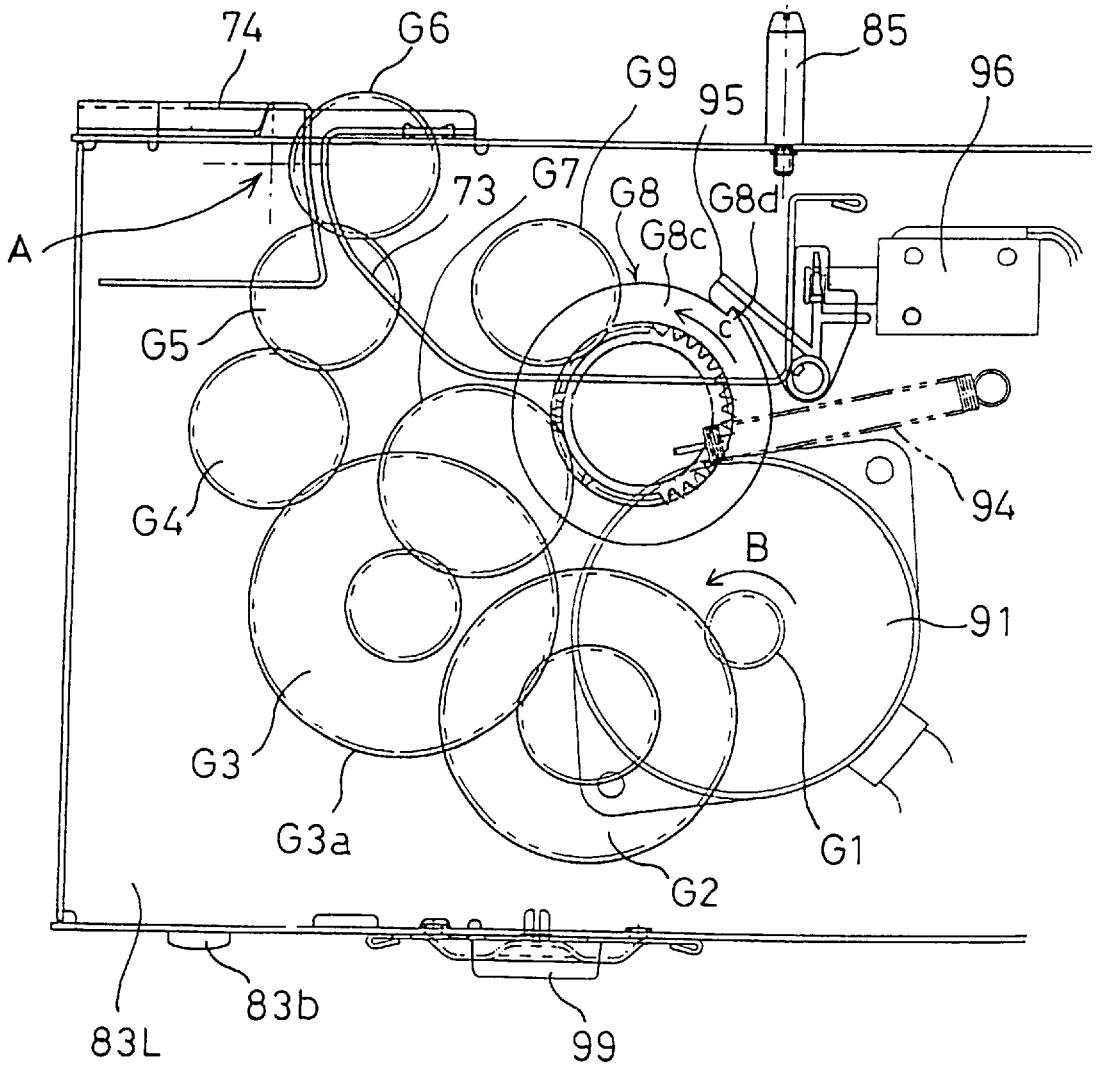
FIG. 7 is a side view showing a roller driving mechanism in the tray units.
Figure 8:
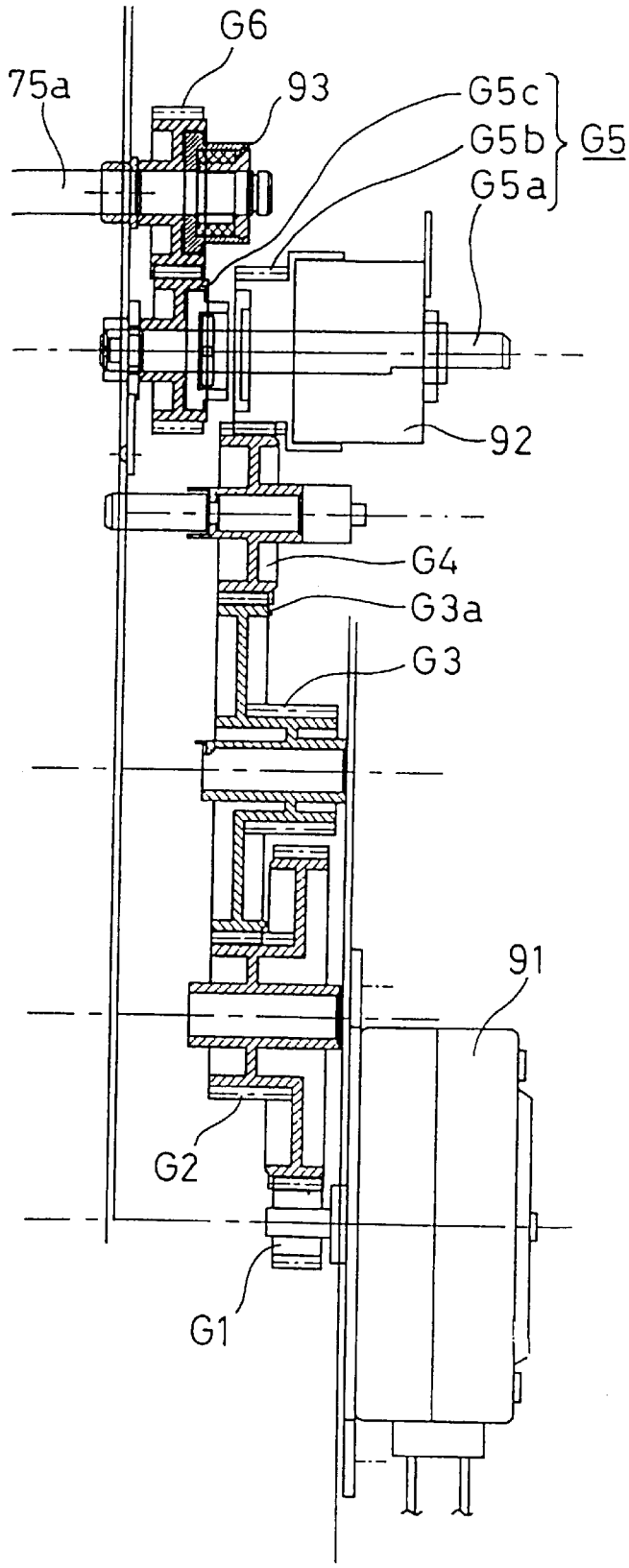
FIG. 8 is a diagram showing an arrangement of gears involved in the driving of a resist roller in the driving mechanism.

As shown in FIGS. 7 and 8, rotation of a pinion gear G1 attached to a drive shaft of a drive motor 91 has its speed reduced by a reduction gear G2, and then is transmitted to an outer gear G3*a* of a reduction gear G3. Rotation of the outer gear G3*a* is transmitted to a gear G5 via a spur gear G4. As shown in FIG. 8, the gear G5 engages the spur gear G4. The gear G5 includes a gear G5*b*, which can change its state of engagement with a shaft G5*a* by means of an electromagnetic clutch 92, and a gear G5*c*, which rotates with the shaft G5*a*. The gear G5*c* engages a gear G6 attached to a shaft 75*a* of the resist roller 75 via a one-way clutch 93.

The one-way clutch 93 transmits the rotation of the gear G6 to the shaft 75*a* and the resist roller 75 only in a direction of conveying the recording sheet toward the main unit 1, that is, the one-way clutch 93 does not transmit the rotation of the gear G6 in the opposite direction. In FIG. 7, a center of the following roller 76 is indicated with A. The following roller 76 rotates following the resist roller 75 while sandwiching the recording medium therebetween. With this structure, the resist roller 75 and the following roller 76 freely rotate in the sheet feeding direction at all times. When the drive motor 91 is driven in a direction, indicated with an arrow B in FIG. 7, and the electromagnetic clutch 92 is engaged, the resist roller 75 and the following roller 76 are forcefully rotated in the sheet feeding direction.

The rotation speed of the pinion gear G1 is reduced by the reduction gears G2, G3, and then is transmitted to a spur drive gear G7. The drive gear G7 is connected with a sheet feed gear G9, and rotates together with the sheet feed gear G9, via a sector gear G8.

Figure 9:
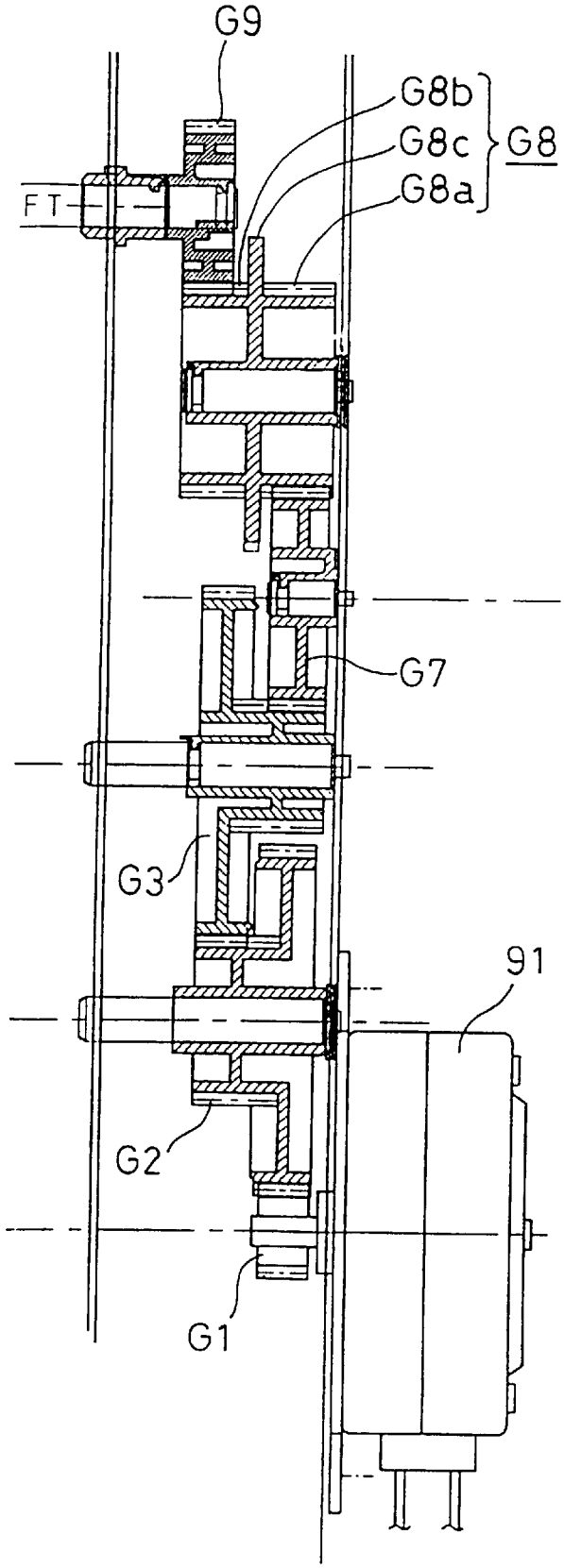
FIG. 9 is a diagram showing an arrangement of gears involved in the driving of a sheet feed roller in the driving mechanism.

As shown in FIG. 9, the sector gear G8 includes two gear portions G8*a*, G8*b* and a cam plate G8*c* formed between the gear portions G8*a* and G8*b*. The gear portions G8*a* and G8*b* are different in a teeth arrangement. As shown in FIG. 7, torque in a direction indicated with an arrow C is applied to the sector gear G8 by a coil tension spring 94. A pawl G8*d* formed to the cam plate G8*c* engages a lever 95, so that the sector gear G8 is always held at an initial position as shown in FIG. 7. The lever 95 swings in accordance with driving of a solenoid 96, and disengages from the pawl G8*d* while the solenoid 96 is being driven.

Figure 10A:
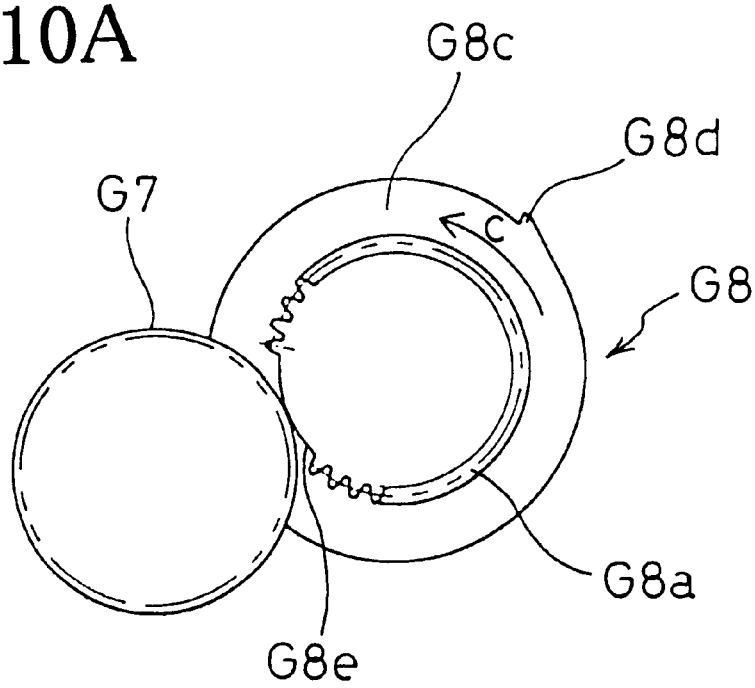
FIGS. 10A and 10B are diagrams showing a positional relationship between a sector gear and another gear in the driving mechanism.
Figure 10B:
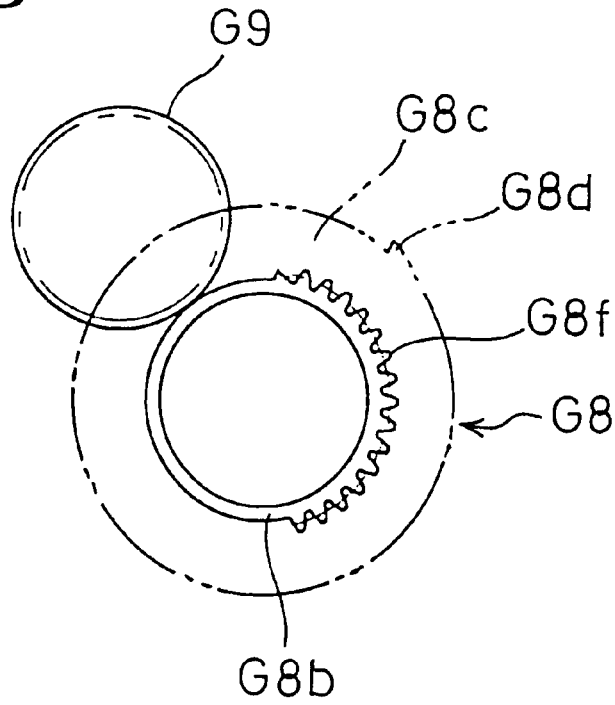

As shown in FIG. 10A, the gear portion G8*a* has a non-toothed portion G8*e*, which faces the drive gear G7 in the initial position. As shown in FIG. 10B, the gear portion G8*b* has teeth G8*f* along its periphery across a predetermined length at a position which does not face the sheet feed gear G9 in the initial position. Therefore, power is transmitted to the sheet feed roller 9 and the sheet feed gear G9, which rotates with the sheet feed roller 9 as described below.

When the sector gear G8 is placed in the initial position, no power is transmitted to the sector gear G8 or the sheet feed gear G9 even when the drive gear G7 rotates. Upon the disengagement of the lever 95 and the pawl G8*d* by driving the solenoid 96 for a moment, the sector gear G8 rotates in the direction of the arrow C and the gear portion G8*a* engages the drive gear G7.

At that time, if the drive motor 91 rotates in the direction of the arrow B, the sector gear G8 further rotates in the direction of the arrow C by the power transmitted from the drive gear G7. As a result, the teeth G8*f* of the gear portion G8*b* engage the sheet feed gear G9. With this engagement, the sheet feed gear G9 rotates a predetermined amount, and the sector gear G8 continues rotating after the teeth G8*f* no longer engage the sheet feed gear G9. Then, when the non-toothed portion G8*e* faces the drive gear G7 again, the power is not transmitted to the sector gear G8 from the drive gear G7, so that the sector gear G8 automatically stops rotating. At that time, the pawl G8*d* substantially engages the lever 95 and the sector gear G8 is held in the initial position.

A driving amount of the sheet feed roller 9 to be driven by the engagement of the teeth G8*f* of the gear portion G8*b* and the sheet feed gear G9 is set such that an uppermost recording sheet stacked on the sheet supporting plate 5 is conveyed and a leading edge of the recording sheet makes contact with the resist roller 75 so that the recording sheet is slightly warped. In the first sheet passage 3*b* (see FIG. 5), a sensor 98 (see FIG. 11), which detects an approach of the leading edge of the recording sheet toward the resist roller 75, is provided. As shown in FIGS. 5 and 7, on the bottom surface of the main unit 1 and each tray unit 71, a connector 99 is provided to serially transmit signals to lower tray units 71 from a control system (not shown) provided to the main unit 1.

Figure 11:
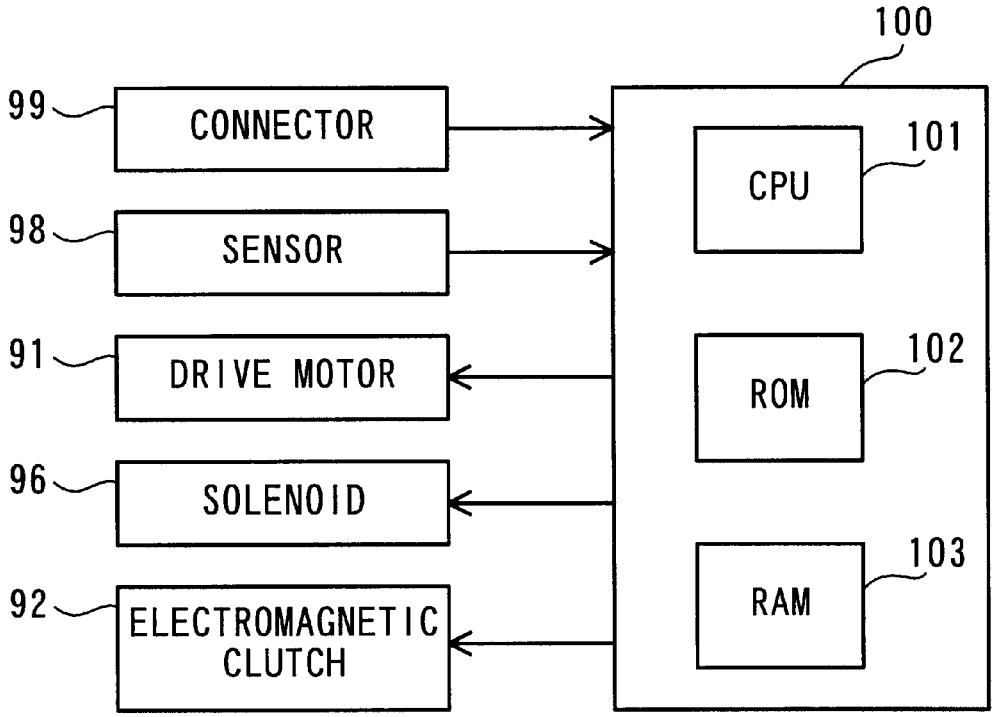
FIG. 11 is a block diagram showing a control circuit of the driving mechanism.

As shown in FIG. 11, the drive motor 91, the electromagnetic clutch 92, the solenoid 96, the sensor 98 and the connector 99 are connected to an electronic control circuit 100, which controls all operations of the tray units 71. The electronic control circuit 100 is a microcomputer that includes a CPU 101, a ROM 102 and a RAM 103. The electronic control circuit 100 controls each portion in accordance with a sheet feeding command transmitted from the main unit 1 via the connector 99, as described below.

The electronic control circuit 100 repeatedly performs the control when a predetermined time is elapsed, in accordance with a software program stored in the ROM 102. The shaft G5*a* and the gear G5*b* are engaged with each other by the electromagnetic clutch 92, that is, the shaft G5*a* and the gear G5*b* are brought into the initial state when the control is started.

Figure 12:
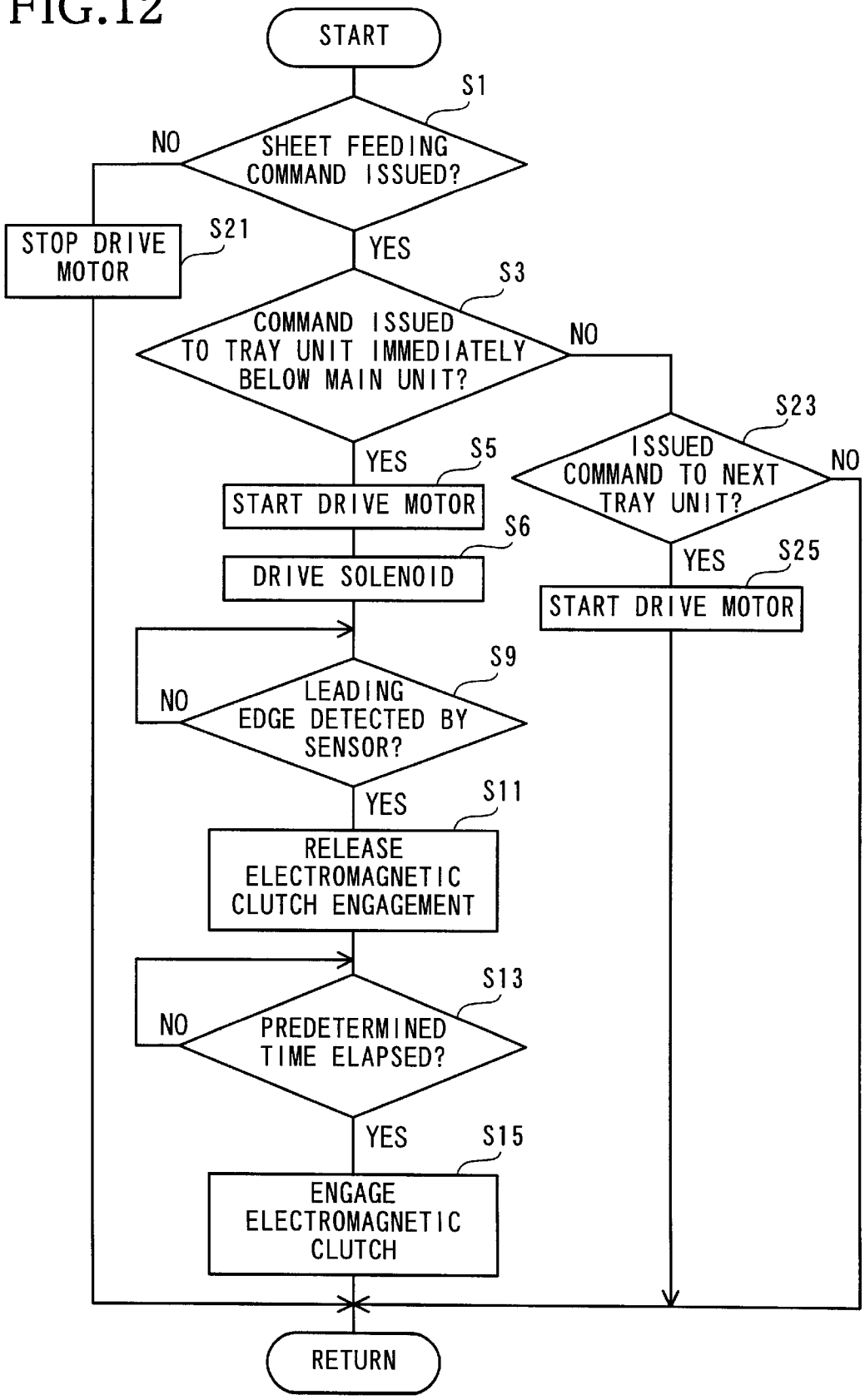
FIG. 12 is a flowchart showing control is to be executed in the control circuit.

At S1 (hereinafter, S stands for a step), FIG. 12, the control circuit 100 determines whether the main unit 1 issues a sheet feeding command. When the sheet feeding command is issued (S1:YES), the control circuit 100 determines whether the command is issued to a tray unit 71 immediately below the main unit 1 (S3). When the command is issued to the tray unit 71 immediately below the main unit 1 (S3:YES), flow moves to S5. At S5, the control circuit 100 drives the drive motor 91 in the direction of the arrow B. At S6, the control circuit 100 drives the solenoid 96 for a moment. By doing so, as described above, the sheet feed roller 9 in the tray unit 71 rotates, so that an uppermost sheet in the stacked sheets on the sheet supporting plate 5 in the tray unit 71, to which the command is issued, can be separated from the other sheets and can be fed toward the resist roller 75.

At S9, the control circuit 100 waits until the sensor 98 detects an approach of a leading edge of the recording sheet. When the sensor 98 detects the approach of the leading edge (S9:YES), the control circuit 100 releases the engagement of the shaft G5*a* and the gear G5*b* by the electromagnetic clutch 92 at S11. As a result, the resist roller 75 is at a standstill unless an external force specially acts on the resist roller 75. At S13, control circuit 100 waits until a predetermined time has elapsed. By doing so, the leading edge of the recording sheet contacts and temporarily stops at the resist roller 75, to slightly warp the recording sheet, so that a deviation of the sheet can be adjusted.

When the adjustment of the deviation of the sheet is completed after the expiration of a predetermined time interval (S13 YES), the electromagnetic clutch 92 is engaged again at S15 and the control circuit 100 temporarily terminates control. At S15, the resist roller 75 is forcefully rotated, so that the adjusted recording sheet can be conveyed toward the main unit 1. The control described above is repeatedly performed while the sheet feeding command is issued to the tray unit 71 immediately below the main unit 1 (S1:YES, S3:YES). By doing so, an uppermost sheet can be separated from the stacked sheets held by the sheet supporting plate 5, one by one, and then can be fed toward the main unit 1 after the deviation of the sheet is adjusted.

On the other hand, when the sheet feeding command is not issued to any tray unit 71 (S81:NO), flow moves to S21 and the control circuit 100 stops the drive motor 91 and temporarily terminates the control. When the sheet feeding command is issued (S1:YES) but is not issued to the tray unit 71 immediately below the main unit 1 (S3:NO), flow moves to S23. Then, the control circuit 100 determines whether the command is issued to a tray unit 71 disposed under the tray unit 71 immediately below the main unit 1. When the command is issued to the tray unit 71 disposed under the tray unit 71 immediately below the main unit 1 (S23:YES), the control circuit 100 starts the drive motor 91 in the direction of the arrow B (S25) and temporarily terminates the control.

As described above, the electromagnetic clutch 92 is controlled to be usually in the engagement state. Therefore, when the drive motor 91 is started, the resist roller 75 is forcefully rotated in the sheet feeding direction. Accordingly, by performing the control at S25, the recording sheet fed from the tray units 71 disposed under the tray unit 71 immediately below the main unit 1 via the second sheet passage 3*a* can be conveyed toward the main unit 1.

After that, flow is repeatedly performed on tray units 71 disposed under (upstream of) those tray units 71 described above in the downward direction.

With the control described above, when the sheet feeding command is issued to the tray unit 71 provided immediately below the main unit 1, the recording sheet is adjusted in its deviation and then can be conveyed to the main unit 1. When the command is issued to any one of tray units 71 disposed under the tray unit 71 provided immediately under the main unit 1, the recording sheet fed, from the tray unit 71 to which the command is issued, can be conveyed toward the main unit 1.

The recording sheet fed to the main unit 1 is conveyed to the resist roller 15 by the sheet feed roller 11, 13. When a sensor detects an approach of the leading edge of the recording sheet toward the resist roller 15, the resist roller 15 is brought into a standstill. The resist roller 15 is at a standstill for a predetermined interval so that a leading edge of the recording sheet is stopped at the resist roller 15 and the sheet is slightly warped. As a result, a deviation of the recording sheet is adjusted. After the expiration of the predetermined interval, the resist roller 15 is rotated to convey the recording sheet to the image forming unit 7.

As described above, in this embodiment, a deviation of a recording sheet is adjusted not only by the resist roller 15 provided upstream of the image forming unit 7 but also the resist roller 75 in the tray unit 71, to which the sheet feeding command is issued. Therefore, even if a distance of the sheet feeding path becomes longer by stacking several tray units 71, the deviation of the recording sheet is satisfactory restricted, so that an image can be precisely formed on the recording sheet. The resist roller 75 also has a function of feeding, toward the main unit 1, the recording sheet fed from any one of the lower tray units 71 disposed under the tray unit 71 immediately below the main unit 1, so that the structure of the tray units 71 can be simplified. This results in reducing the size of the laser-beam printer. In the laser-beam printer, the necessary number of tray units 71 can be stacked one upon the other under the main unit 1, so that the laser-beam printer does not become oversized.

The sheet feed roller 9 and the resist roller 75 are driven by the single drive motor 91, so that the tray units 71 can be further simplified in structure. Accordingly, the laser-beam printer can be reduced in size and smoothly operated.

The resist roller 75 is driven via the one-way clutch 93. Therefore, the recording sheet is under a tension in the sheet feeding direction, so that the recording sheet can be prevented from being deviated or skewed. That is, when the recording sheet is conveyed via the several resist rollers 75, the leading edge and the trailing edge of the recording sheet are pinched by the two resist rollers disposed downstream and upstream of the sheet feeding direction, respectively. At that time, a tension toward the sheet feeding direction is placed on the recording sheet, if the sheer feeding speed of the resist roller 75 in the downstream is faster than that of the resist roller 75 in the upstream. However, in this embodiment, if such case happens, a slip is caused in the one-way clutch 93 in the upstream due to the tension, so that the sheet feeding speed between the two resist rollers 75 can coincide one another. Accordingly, the recording sheet is prevented from coming deviated.

The order of stacking the tray units 71 may be changed, so that it is conceivable that the sheet feeding speed of the resist roller 75 in the downstream becomes faster than that of the resist roller 75 in the upstream. Even if this case happens, the recording sheet can be prevented from being deviated in this embodiment. Because of this, it is unnecessary to synchronize the resist rollers 75 with each other, so that there is no problem even if a drive motor 91 is provided in each tray unit 71 as described above. Accordingly, in this embodiment, loads on the drive motors 91 are reduced.

While the resist rollers 15, 75 are used to adjust a deviation of the recording sheet in the aforementioned embodiment, it is not restricted to the rollers. For example, a belt or the like can be adopted as long as it functions as the resist rollers 15, 75. Though the drive motor 91 is provided in each tray unit 71 in the embodiment, the several tray units 71 may be driven by a single drive motor 91. In this case, gears may be provided at upper and lower ends of the tray units 71, and exposed therefrom, in order to engage gears provided in another tray unit 71, and power may be transmitted between the tray units 71 by the engagement of the gears.

The power may be transmitted to the sheet feed roller 9, using an electromagnetic clutch or the like, as necessary, instead of the sector gear G8 described above. When the electromagnetic clutch or the like is used, however, it is conceivable that a sensor may be needed to detect timing at which the state of the electromagnetic clutch is changed. As opposed to this, in the structure using the sector gear G8, it can be effectuated, with a simple structure, that the sheet feed roller 9 is rotated by a predetermined amount and then automatically stopped. Consequently, in the aforementioned embodiment, the tray units 71 are reduced in size and operate smoothly.

In the embodiment described above, each tray unit 71 has one sheet cassette 3. However, each of the tray units 71 may have several sheet cassettes 3 therein. For example, a stack of the tray units 71 of the aforementioned embodiment may be regarded as a unit.

While the invention has been described in detail with reference to a specific embodiment thereof, it would be apparent to those skilled in the art that various changes and modifications may be made therein without departing from the spirit of the invention.

What is claimed is:

1. An image forming apparatus, comprising:

at least two recording medium feeding apparatuses that can be stacked under the image forming apparatus, each recording medium feeding apparatus that accommodates a cassette that holds a stack of recording mediums, has a separator for separating the recording mediums, one by one, from the stack, and feeds the separated recording medium;

an image forming apparatus body that can be stacked on a top of a top one of the at least two recording medium feeding apparatuses, and forms an image on the recording medium fed from the recording medium feeding apparatus;

first deviation adjusting means that is provided upstream from an image forming unit that forms the image, in the image forming apparatus body, and temporarily stops the recording medium to adjust its deviation while contacting a leading edge of the recording medium; and second deviation adjusting means that is provided downstream from the separator, in each recording medium feeding apparatus, and temporarily stops a fed recording medium to adjust its deviation while contacting a leading edge of the recording medium, wherein the second deviation adjusting means also functions as conveying means for conveying the recording medium for a lower recording medium feeding apparatus toward the image forming apparatus body.

2. The image forming apparatus according to claim 1, wherein the second deviation adjusting means is a roller that adjusts the deviation of the recording medium while contacting the leading edge of the recording medium, which is at a standstill, and that feeds the recording medium fed from the recording medium feeding apparatus toward the image forming apparatus body after the deviation of the recording medium is adjusted, or a recording medium fed from the lower recording medium feeding apparatus that is stacked under the recording medium feeding apparatus toward the image forming apparatus body, by its rotation.

3. The image forming apparatus according to claim 2, wherein each second deviation adjusting means includes a drive motor that rotates a drive shaft and a one-way clutch that transmits rotation of the drive shaft to the roller, and conveys the recording medium by rotating the roller.

4. The image forming apparatus according to claim 3, wherein each recording medium feeding apparatus includes the drive motor.

5. The image forming apparatus according to claim 4, wherein each recording medium feeding apparatus includes a drive gear that is provided between the drive motor and the separator and is rotated by the drive motor;

a sector gear that engages the drive gear, has a non-toothed portion, is always in a power non-transmitting state when the non-toothed portion is opposed to the drive gear, and is operationally connected to the separator;

a sector gear switching device that actuates according to a predetermined input signal and transmits power from the drive gear to the sector gear by engaging the sector gear with the drive gear from the power non-transmitting state; and an electromagnetic clutch that is provided between a drive shaft rotated by the drive motor and the one-way clutch and transmits and interrupts power from the drive shaft to the one-way clutch.

6. A recording medium feeding apparatus that can be stacked under an image forming apparatus that forms an image on a recording medium, comprising:

a cassette that holds a stack of recording mediums;

a separator that separates the recording mediums one by one from the stack held in the cassette;

a first path that is provided downstream from the separator and guides a recording medium;

a second path that joins the first path and guides a recording medium;

a resist roller that is provided downstream from a confluence of the first path and the second path; and a driving device that rotates the resist roller, after a deviation of a recording medium is adjusted by temporarily stopping the recording medium at the resist roller while the resist roller contacts a leading edge of the recording medium, when the recording medium is fed by the separator to the first path, and that rotates the resist roller without adjusting the deviation of a recording medium when the recording medium is fed from the second path.

7. The recording medium feeding apparatus according to claim 6, wherein the driving device includes a drive motor that rotates a drive shaft and a one-way clutch that transmits rotation of the drive shaft to the resist roller, and conveys the recording medium by rotating the resist roller.

8. The recording medium feeding apparatus according to claim 7, wherein the cassette includes the drive motor.

9. The recording medium feeding apparatus according to claim 8, wherein the recording medium feeding apparatus includes a drive gear that is provided between the drive motor and the separator and is rotated by the drive motor;

a sector gear that engages the drive gear, has a non-toothed portion, is always in a power non-transmitting state when the non-toothed portion is opposed to the drive gear, and is operationally connected to the separator;

a sector gear switching device that actuates according to a predetermined input signal and transmits power from the drive gear to the sector gear by engaging the sector gear with the drive gear from the power non-transmitting state; and an electromagnetic clutch that is provided between a drive shaft rotated by the drive motor and the one-way clutch and transmits and interrupts power from the drive shaft to the one-way clutch.

10. An image forming apparatus, comprising:

an image forming section that forms an image on a recording medium; and a plurality of feeder units positioned under the image forming section, each feeder unit including:

a cassette separator to pick up top sheet of the stack;

a path extending from the separator;

a second path for feeding a sheet from a lower feeder unit;

a resistor roller positioned downstream from a junction of the first path and the second path; and a driving device that drives the resistor roller; and a control device controlling the driving device so that the sheet from the first path is temporarily stopped at the resistor roller and the sheet from the second path is transported through resistor roller without stopping.

11. The recording medium feeding apparatus, according to claim 6, wherein the cassette has a cassette;

body with a supporting plate pivotally mounted in the cassette body for supporting a plurality of recording sheets, the separator is a sheet feed mechanism mounted to the cassette body above a free end of the supporting;

plate, the first feed path extends from a point where the sheet feed mechanism contacts a top recording;

sheet, the second feed path extends from a bottom of the cassette body to join the first feed;

path, the resist roller on the first feed path downstream of the juncture of the first feed path and the second feed path, and further comprising follower roller opposing the resist feed roller to form a nip on the first feed path.

12. The recording medium feeding apparatus according to claim 11, further comprising:

a one of a female and a male connection device at a top side of the cassette; and an opposite one of the female and the male connection device at a bottom side of the cassette.

13. The recording medium feeding apparatus according to claim 12, further comprising electrical connection means for electrically connecting the cassette to at least one of an image forming apparatus and a second cassette.

14. The sheet feed cassette recording medium feeding apparatus according to claim 12, further comprising:

a gear mechanism for driving the sheet feed mechanism and the resist roller; and drive means for driving the gear mechanism.

15. The recording medium feeding apparatus according to claim 14, wherein the drive means comprises a drive motor mounted on the cassette.

16. The recording medium feeding apparatus according to claim 14, wherein the drive mechanism comprises a linking gear mechanism between at least one of an image forming apparatus and an adjacent cassette.

17. The recording medium feeding apparatus according to claim 12, wherein a discharge end of the first feed path downstream of the resist roller and the follower roller is aligned with the second feed path of a second cassette mounted above the cassette.

18. The recording medium feeding apparatus according to claim 14, further comprising a one-way clutch associated with drive of the resist roller to transmit rotation to the resist roller.

19. The sheet feed cassette recording medium feeding apparatus to claim 15, wherein the gear mechanism includes:

a drive gear that is provided between the drive means and the sheet feed mechanism and is rotated by the drive motor;

a sector gear that engages the drive gear, has a non-toothed portion, is always in a power non-transmitting state when the non-toothed portion is opposed to the drive gear, and is operationally connected to the sheet feed mechanism; and a sector gear switching device that actuates according to a predetermined input signal and transmits power from the drive gear to the sector gear by engaging the sector gear with the drive gear from the power non-transmitting state.

* * * * *